United States Patent [19]

Ortiz

[11] 4,216,609

[45] Aug. 12, 1980

[54] TOY GUN

[76] Inventor: Nilson V. Ortiz, 2911 16th St. ©210, San Francisco, Calif. 94103

[21] Appl. No.: 960,981

[22] Filed: Nov. 15, 1978

[51] Int. Cl.[2] ..... A63H 35/00

[52] U.S. Cl. ..... 46/38; 46/196

[58] Field of Search ..... 46/38, 196, 197, 198, 46/199, 200, 1 E, 176; 124/2, 55; 272/27 R

[56] References Cited

U.S. PATENT DOCUMENTS

| | | | |
|---|---|---|---|
| 825,843 | 7/1906 | Kliemandt | 46/38 |
| 2,336,391 | 12/1943 | Burchett | 46/201 X |
| 2,345,173 | 3/1944 | Baggott | 46/1 E |
| 3,731,421 | 5/1973 | Frattolillo et al. | 46/248 X |
| 3,757,760 | 9/1973 | Darnell | 124/35 R X |

*Primary Examiner*—Louis G. Mancene
*Assistant Examiner*—Mickey Yu
*Attorney, Agent, or Firm*—Robert K. Rhea

[57] ABSTRACT

A toy hand gun, having a socket formed in the forward end portion of its barrel for coaxially supporting a generally cylindrical fireworks-type novelty item. A trigger member is slidably supported by the barrel for movement toward and away from the handle for igniting an explosive charge contained by the novelty item when its firing cord is connected with the trigger member and quickly extracted.

5 Claims, 7 Drawing Figures

TOY GUN

BACKGROUND OF THE INVENTION

1. Field of the Invention

The present invention relates to toys and more particularly to a toy hand gun.

One of the currently popular fireworks-type novelty items comprises a plastic and paper product in the form of a miniature hollow container simulating a champagne bottle which is known as a "Party Popper". The party popper contains confetti, or the like, which is discharged from the large end of the bottle shape by an explosive charge comprising a small quantity of powder disposed in the bottle neck portion and triggered by a projecting firing cord which, when manually extracted or jerked from the bottle neck, fires the charge to eject and scatter the bits of paper. This novelty item, when used by children, should be under close adult supervision for the reason neither end of the item should be pointed toward the face of the user or another person or held near the ear.

The present invention is intended for safely holding and releasing such a novelty item.

2. Description of the Prior Art

U.S. Pat. No. 3,731,421 discloses a gun-like toy which discharges confetti through its barrel in response to the forced air draft of a battery powered fan contained by the device. U.S. Pat. No. 2,345,173 discloses a noise producing toy gun which also discharges powdered material from its barrel in response to its rearwardly biased barrel being moved forwardly by a manually rotated cam so that air trapped by the barrel movement discharges the powder through the barrel to simulate firing a shell.

SUMMARY OF THE INVENTION

In the preferred embodiment, an elongated toy gun barrel is provided with a handle at one end with the other end of the barrel having an axial socket therein communicating with a vertically open space intermediate the ends of the barrel defining a longitudinally extending slot which slidably supports a trigger member for movement toward and away from the handle. A bottle-shaped novelty item, axially disposed within the socket, includes a release string or cord connectable with the trigger member for firing an explosive contained by the novelty item by movement of the trigger member toward the handle.

In another embodiment, the forward end of the gun barrel axially supports a turret containing a plurality of the explosive charge fired novelty items, successively rotated into firing position, in which the firing cord of each novelty item is in turn connected with a trigger member slidably surrounding the gun barrel.

In another embodiment, the gun barrel is tubular and open at both ends with the novelty item explosive charge release cord projecting longitudinally through the gun barrel for releasing the charge by a pull exerted on the cord at the handle end of the barrel.

The principal object of this invention is to provide a toy gun for supporting and aiming a fireworks-type novelty item at an inanimate target which includes a sliding trigger member for quickly extracting the firing cord from the novelty item.

DESCRIPTION OF THE PREFERRED EMBODIMENTS

Figure 1:
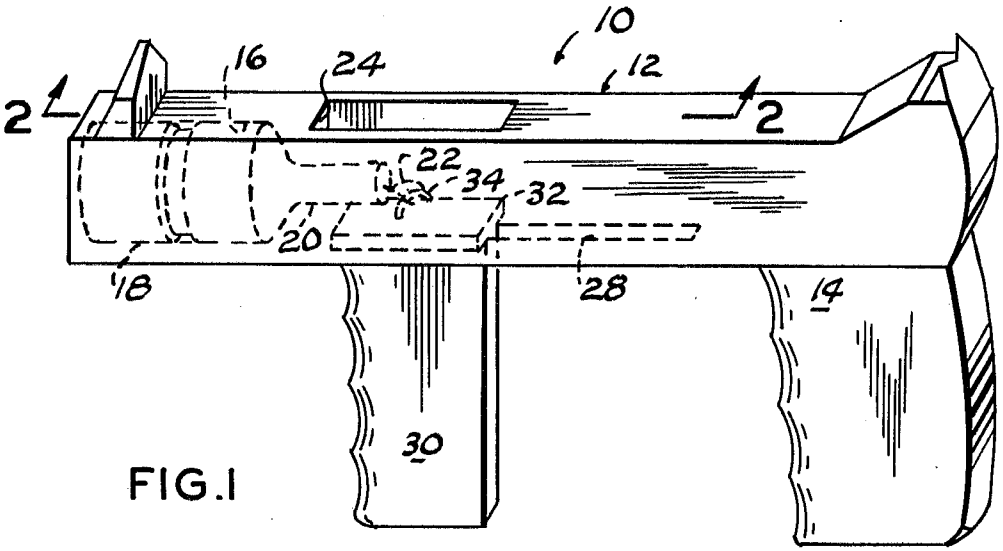
FIG. 1 is a perspective view of the toy hand gun illustrated, by dotted lines, the relative position of the novelty item when contained thereby.

Like characters of reference designate like parts in those figures of the drawings in which they occur.

Figure 2:
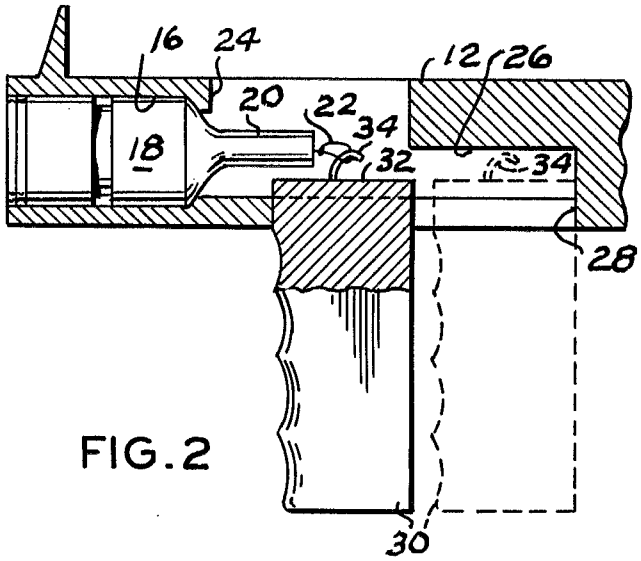
FIG. 2 is a fragmentary cross sectional view taken substantially along the line 2—2 of FIG. 1.

In the drawings:

Referring more particularly to FIGS. 1 and 2, the reference numeral 10 indicates a pistol-type toy gun having a rod-like member simulating a barrel 12 and a handle 14. The forward end of the barrel is provided with an axial socket 16 for nesting a generally cylindrical bottle-neck novelty item 18, presently marketed under the name "Party Popper", having a neck portion 20 containing an explosive charge of powder, not shown, which is actuated by a cord 22 when it is manually withdrawn quickly from the neck. Intermediate its ends and medially its transverse dimension the barrel 12 is provided with an upwardly open recess or opening 24 communicating with the socket 16 for access to the bottle neck and cord 22. The opening 24 is extended longitudinally of the barrel toward the handle 14, as at 26, and communicates with a groove 28 longitudinally formed in the depending surface of the barrel. The transverse width of the groove 28 is substantially less than the transverse dimension of the opening 24.

A panel-like member 30 is slidably received by the groove 28 and projects downwardly from the barrel 12 substantially equidistant with respect to the handle 14. The trigger member 30 is provided with a head portion 32 which overlaps opposing edge surfaces defining the groove 28 and is slidable longitudinally of the barrel within the openings 24 and 26. An upstanding prong or hook 34 is secured to the trigger head 32 for engaging the cord 22 and withdrawing it from the bottle neck 20 when the trigger member 30 is manually moved toward the handle 14, as shown by dotted lines (FIG. 2). In addition to providing access to the cord 22 for engaging it with the hook 34 of the barrel opening 24 contains any misfire of the explosive from the bottle neck end when the powder is fired.

Figure 3:
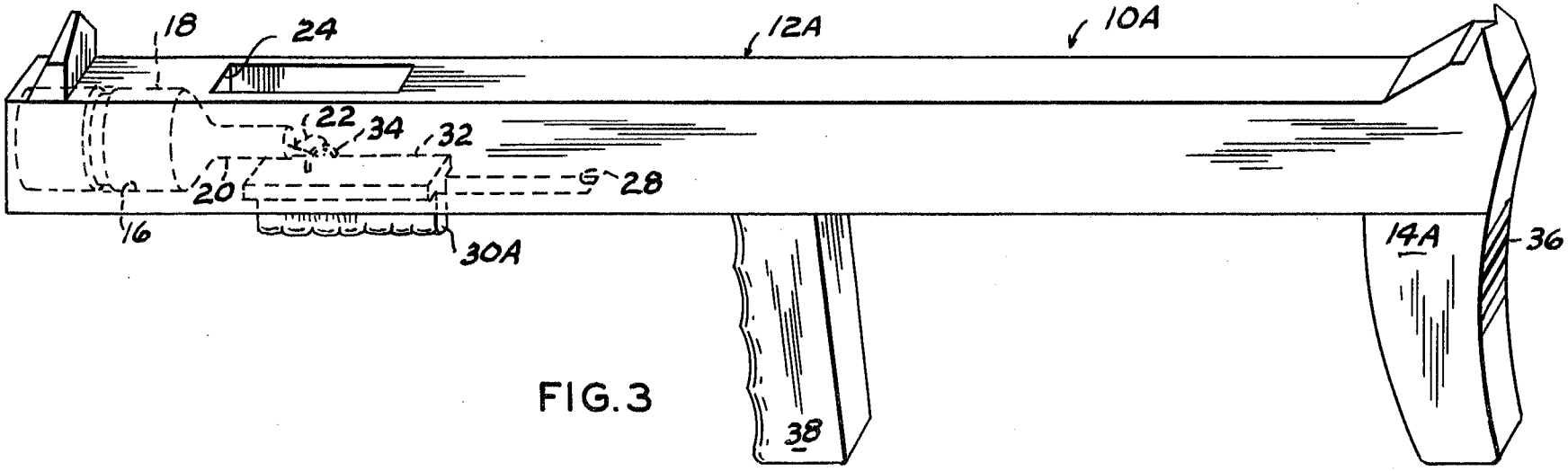
FIG. 3 is a view similar to FIG. 1 illustrating a rifle-like configuration of the toy gun.

Referring also to FIG. 3, the numeral 10A indicates a modified form of the toy gun simulating a carbine or rifle of the pump gun type. In this embodiment, the handle 14A is arcuately curved, as at 36, to fit the user's shoulder and a hand grip 38 depends from the gun barrel 12A intermediate its ends. The trigger member 30A is modified so that its end portion depending from the gun barrel simulates a conventional pump gun wooden hand grip.

Figure 4:
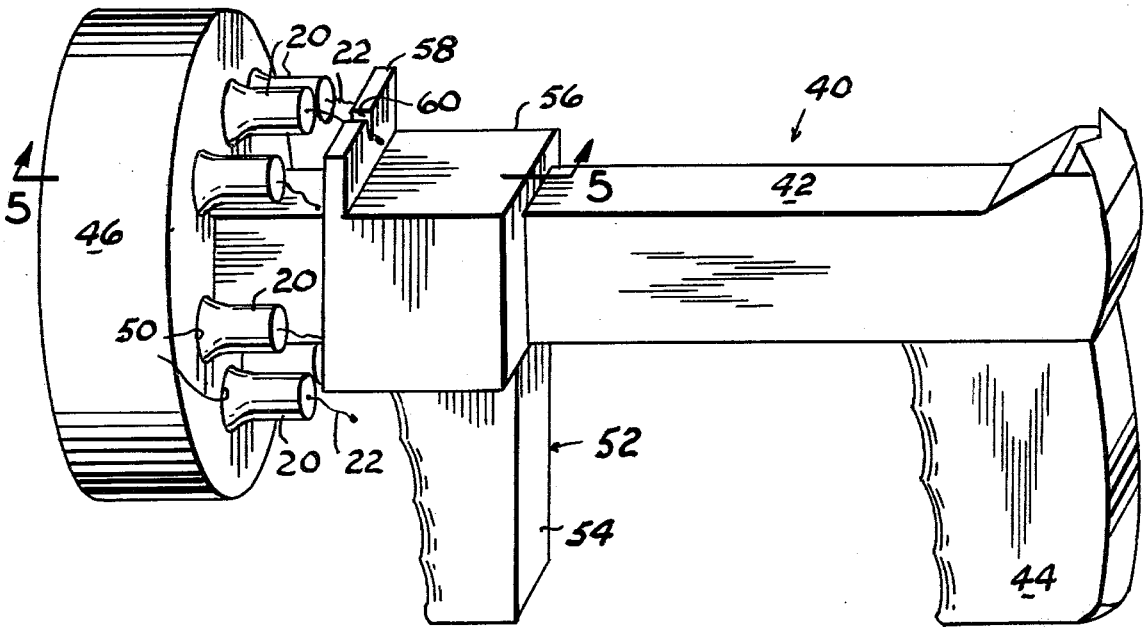
FIG. 4 is a perspective view of the toy gun having a novelty item supporting turret attached to the forward end of the gun barrel.
Figure 5:
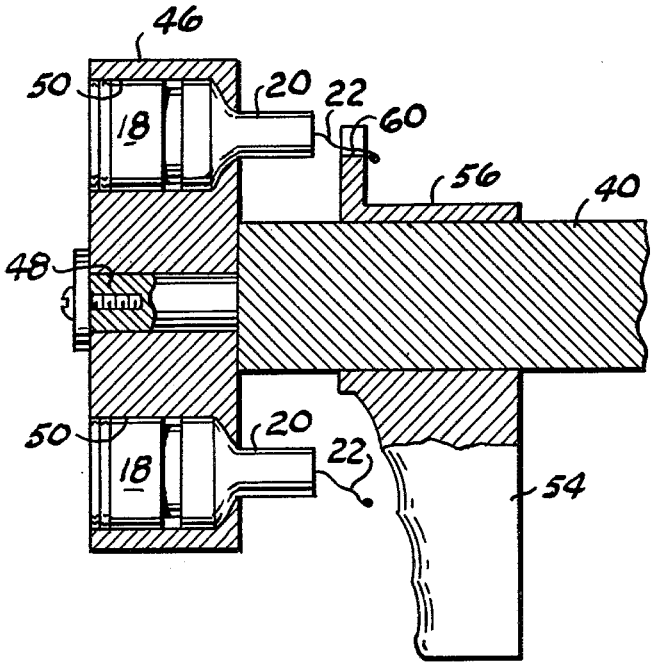
FIG. 5 is a vertical cross sectional view taken substantially along the line 5—5 of FIG. 4.

Referring now to FIGS. 4 and 5, a modification of the toy gun is indicated at 40, comprising a similar pistol-type toy gun having a gun barrel 42 connected at one end with a handle 44. A cylindrical turret 46 is coaxially mounted on an axial extension 48 of the gun barrel for rotation of the turret therearound. The turret is provided with a plurality of circumferentially spaced sockets 50, each nesting one of the novelty items 18 with its neck 20 projecting through the turret toward the handle end of the barrel. The radial spacing of the sockets 50, form the axis of the turret, is such that the bottle necks 20 are disposed adjacent the peripheral surfaces of the gun barrel.

A trigger member 52, having a handle portion 54 depending from the gun barrel, is provided with a box-like upper end section 56 which slidably surrounds the gun barrel 42 for movement toward and away from the turret. The box section 56 is provided with a forward upstanding transverse wall 58 having a central slot 60 in its upper edge portion for receiving an end portion of the cord 22 to withdraw the cord from the bottle neck 20 when the trigger member is moved toward the handle 44.

Figure 6:
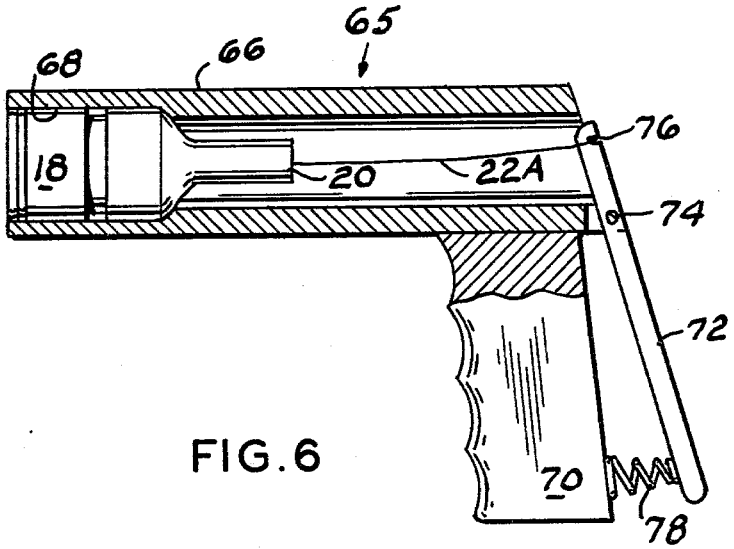
FIG. 6 is a vertical cross sectional view, partially in elevation, illustrating another embodiment of the toy gun; and, FIG. 7 is a view similar to FIG. 6 illustrating a further simplified embodiment of the toy gun.

Referring now to FIG. 6, another embodiment of the toy gun simulating a bazooka is indicated at 65 in which the barrel 66 is tubular and provided with a counterbore 68 in its forward end portion for coaxially nesting the novelty item 18. A handle 70 is connected with the other end portion of the barrel. A rod-like trigger member 72 is pivotally connected intermediate its ends, as at 74, to the rearward end portion of the barrel. The upwardly disposed end of the trigger member 72 is provided with a notch 76 for receiving the cord 22A when elongated. A spring member 78 is interposed between the depending end portions of the handle 70 and trigger member 72 for normally biasing the trigger member away from the handle. The trigger member 72 is manually moved toward the handle to withdraw the cord 22A from the bottle neck.

Figure 7:
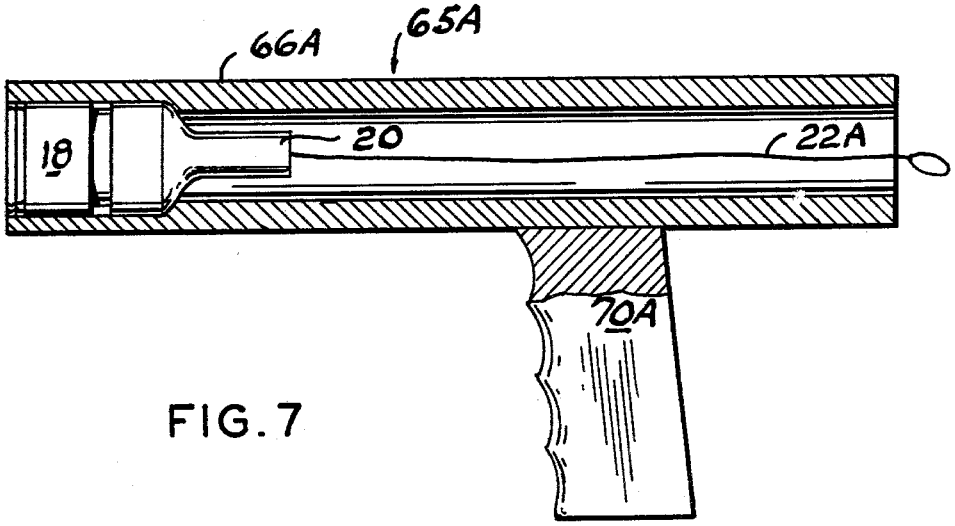

Referring also to FIG. 7, a simplified embodiment of the gun is indicated at 65A. In this embodiment, the barrel 66A is elongated to more nearly resemble a bazooka and the handle 70A is connected intermediate the ends of the barrel. The elongated cord 22A similarly projects beyond the rearward open end of the barrel to be manually pulled for firing the explosive charge.

Obviously the invention is susceptible to changes or alterations without defeating its practicability. Therefore, I do not wish to be confined to the preferred embodiment shown in the drawings and described herein.

I claim:

1. A toy gun in combination with an amusement-type novelty item, said novelty item being generally bottle-shaped and having a neck portion containing an explosive charge of powder ignited by a firing cord being pulled out of the neck portion, the improvement comprising:

a normally horizontally disposed barrel having a handle connected therewith, said barrel having a forward end and having its bore enlarged at its forward end portion to define a forwardly open cylindrical socket for nesting said novelty item with its longitudinal axis parallel with the longitudinal axis of said barrel; and, trigger means supported by and moveable relative to said barrel for engaging said firing cord and axially withdrawing it from said neck portion.

2. The combination according to claim 1 in which said barrel is provided with a vertical opening intermediate its ends communicating with the socket and forming a longitudinal slot in its depending surface and in which said trigger means includes:

a panel-like trigger member slidable within the slot and having a head portion overlapping the wall surfaces defining the slot; and, means on said head portion for holding an intermediate portion of said cord.

3. The combination according to claim 1 in which said trigger means includes:

a generally vertically disposed elongated rod-like trigger member pivotally connected intermediate its ends with the rearward end portion of said barrel for vertical pivoting movement of its depending end portion toward and away from said barrel; and, means on the other end portion of said trigger member for holding an intermediate portion of said cord.

4. The combination according to claim 1 and further including:

a turret journalled by the forward end portion of said barrel for rotation in a plane normal to the longitudinal axis of said barrel, said turret having a plurality of circumferentially spaced sockets for nesting a like plurality of said novelty items with their axes parallel with the longitudinal axis of said barrel.

5. The combination according to claim 4 in which said trigger means comprises:

a trigger member depending from said barrel and having a box-like upper end section slidably surrounding said barrel; and means on said box-like end section for holding at least one of said firing cords.

* * * * *